US005156304A

United States Patent [19]

Battegazzore

[11] Patent Number: 5,156,304

[45] Date of Patent: Oct. 20, 1992

[54] TRIGGER-TYPE DEVICE FOR A SPRAYER PUMP FOR USE ON HANDHELD CONTAINERS

[75] Inventor: Piero Battegazzore, Alessandria, Italy

[73] Assignee: Guala S.p.A., Alessandria, Italy

[21] Appl. No.: 669,906

[22] Filed: Mar. 15, 1991

[30] Foreign Application Priority Data

Mar. 27, 1990 [IT] Italy ..... 19828 A/90

[51] Int. Cl.[5] ..... B65D 88/54

[52] U.S. Cl. ..... 222/341; 222/383; 222/385; 239/333

[58] Field of Search ..... 239/333; 222/207, 321, 222/341, 383, 385

[56] References Cited

U.S. PATENT DOCUMENTS

| | | | |
|---|---|---|---|
| 1,900,668 | 3/1933 | Roselund | 222/385 X |
| 3,478,935 | 11/1969 | Brooks | 222/321 |
| 3,840,157 | 10/1974 | Hellenkamp | 222/385 X |
| 4,077,549 | 3/1978 | Beard | 222/321 |
| 4,241,853 | 12/1980 | Pauls et al. | 222/383 X |
| 4,271,990 | 6/1981 | Kutic et al. | 222/321 |
| 4,278,187 | 7/1981 | Luedtke | 222/321 X |
| 4,506,805 | 3/1985 | Marcon | 222/321 X |
| 4,606,480 | 8/1986 | Rodriguez Gazulla | 222/341 |
| 4,917,303 | 4/1990 | Maas et al. | 222/383 X |
| 4,953,791 | 9/1990 | Tada | 222/383 X |

FOREIGN PATENT DOCUMENTS 2398196 2/1979 France .

*Primary Examiner*—Andres Kashnikow
*Assistant Examiner*—Kenneth Bomberg
*Attorney, Agent, or Firm*—Notaro & Michalos

[57] ABSTRACT

A trigger-type device for operating a pump of the axial displacement piston type against a bias spring, sprays liquids out of a handheld container. The pump has a delivery head which is movable axially with the piston and provided with a delivery conduit set at an angle to the displacement axis of the piston and lying in the same plane where the angular movement of the trigger lever takes place. The device includes a rocker lever which converts the angular movement of the trigger lever into a corresponding axial displacement of the delivery head to thereby drive the pump piston against the bias spring and produce the spray.

8 Claims, 5 Drawing Sheets

TRIGGER-TYPE DEVICE FOR A SPRAYER PUMP FOR USE ON HANDHELD CONTAINERS

FIELD AND BACKGROUND OF THE INVENTION

This invention relates to a trigger-type device for operating a pump of the axial displacement piston type against a bias spring in order to spray liquids out of a handheld container, said pump having a spray delivery head which is movable axially together with the piston and provided with a delivery conduit extending at an angle to the piston displacement line substantially in the same plane where the angular movement of the trigger lever occurs, said device comprising a base body for supporting said pump and the trigger lever and for connection to the container mouth end.

Trigger-type devices of the kind outlines above have been long known in the related art and are currently employed for spraying liquids through the pressure developed by the mechanical action of the trigger lever on the pump, instead of using a gas propellant loaded into the container together with the liquid to be sprayed.

Such known devices have failed, however, to receive widespread acceptance because, although beneficial from an environmental standpoint, due to mechanical parts entering their construction which are subjected to reiterate stresses, they are liable to wear rapidly, and this also on account of the materials used for their construction being in general low grades, in order to fill the demand for disposability that usually underlies the manufacture of devices of this kind.

In addition, the constructions of conventional devices disallow automated assembly procedures for their component parts which could be implemented in a cost-efficient and straightforward manner.

Lastly, a non-negligible drawback of conventional devices is that their component parts are designed to make up a device suiting a specific type of respective container or a narrow range of container designs, which obviously restricts their field of application.

A known device of the kind mentioned above is illustrated by U.S. Pat. No. 3,478,935, for example, As brought out therein, the trigger-type lever or handle of the device is unitary with a lever which converts the angular movement of the trigger-type lever into a straight-line axial displacement of the pump piston and has substantial length, being pivoted on the base body at a very remote location from the trigger-type lever or handle.

In use, large flexural stresses are obviously applied to the lever-trigger handle combination which require that high grade, and hence expensive, materials be employed if long operational life is sought for the device.

Furthermore, in view of the complex construction of its components parts, the device of the aforementioned U.S. patent is unsuitable for automated assembly procedures using simple operations to be all carried out, for instance, in parallel with one and the same direction.

Another example of a known device is illustrated by French Patent Publication No. 2 398 196 which, once again, exhibits the same drawbacks as the device of U.S. Pat. No. 3,478,935.

In addition, and especially from the example of French Publication No. 2 398 196, it may be seen that its component parts are designed to match a specific configuration of the container and cannot provide a structurally independent device adaptable to a range of differently shaped containers.

SUMMARY OF THE INVENTION

It is the object of this invention to provide a trigger-type device for operating a pump of the axial displacement piston type against a bias spring, to spray liquids from a handheld container, which is structurally unrelated to the shape of the container for which it is intended, is highly reliable in terms of durability, thereby it can also be used with re-fill containers, while being cost-efficient and adapted for manufacture by assembly procedures which are readily and economically automatizable.

This object is achieved by a trigger-type device as indicated being characterized as in the appended claims.

BRIEF DESCRIPTION OF THE DRAWINGS

The invention will be now described with reference to a practical embodiment thereof, shown by way of illustration and not of limitation in the accompanying drawings, where.

DESCRIPTION OF THE PREFERRED EMBODIMENT

Figure 1:
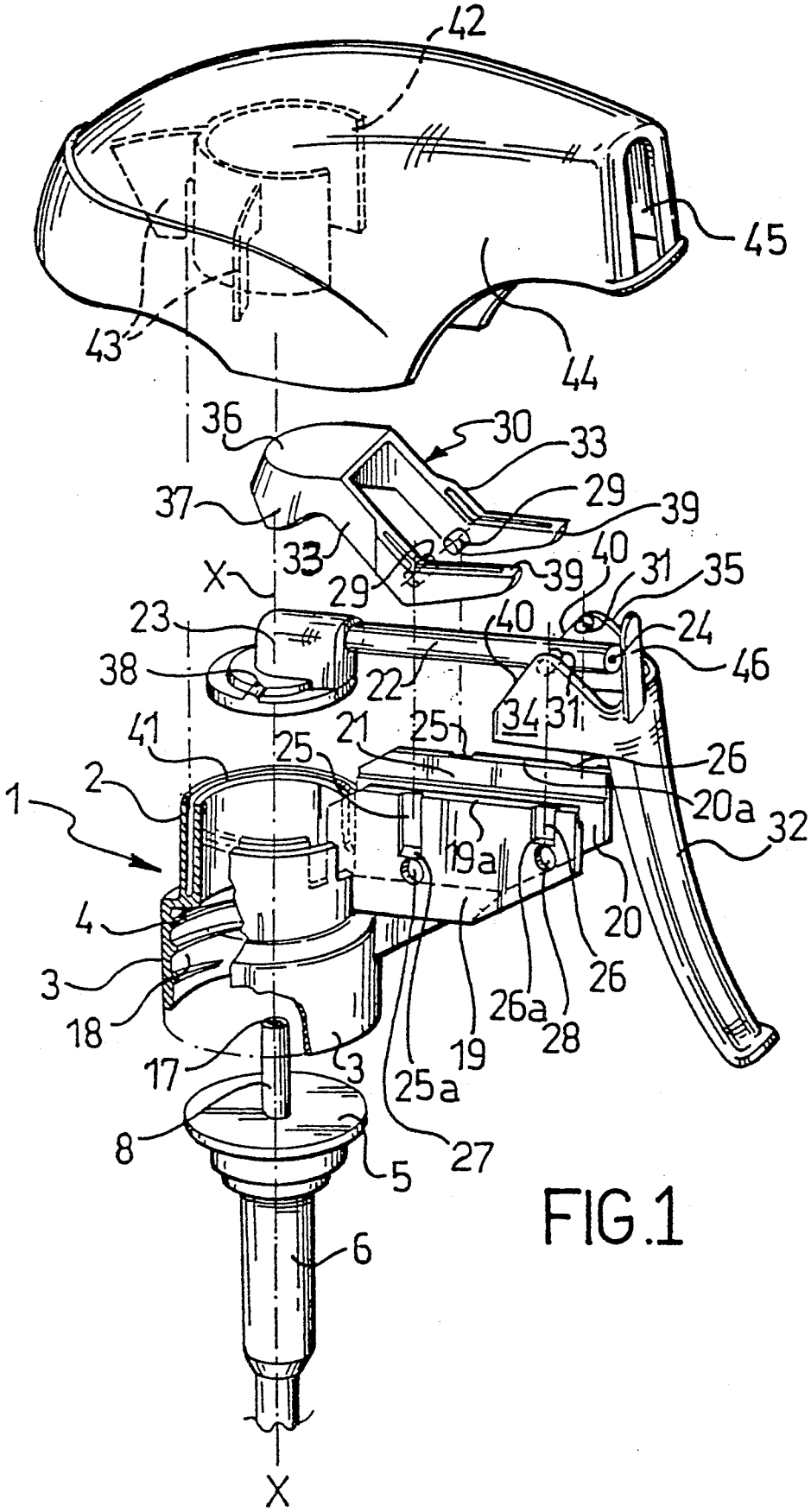
FIG. 1 is an exploded perspective view of the component parts of the inventive device.
Figure 2:
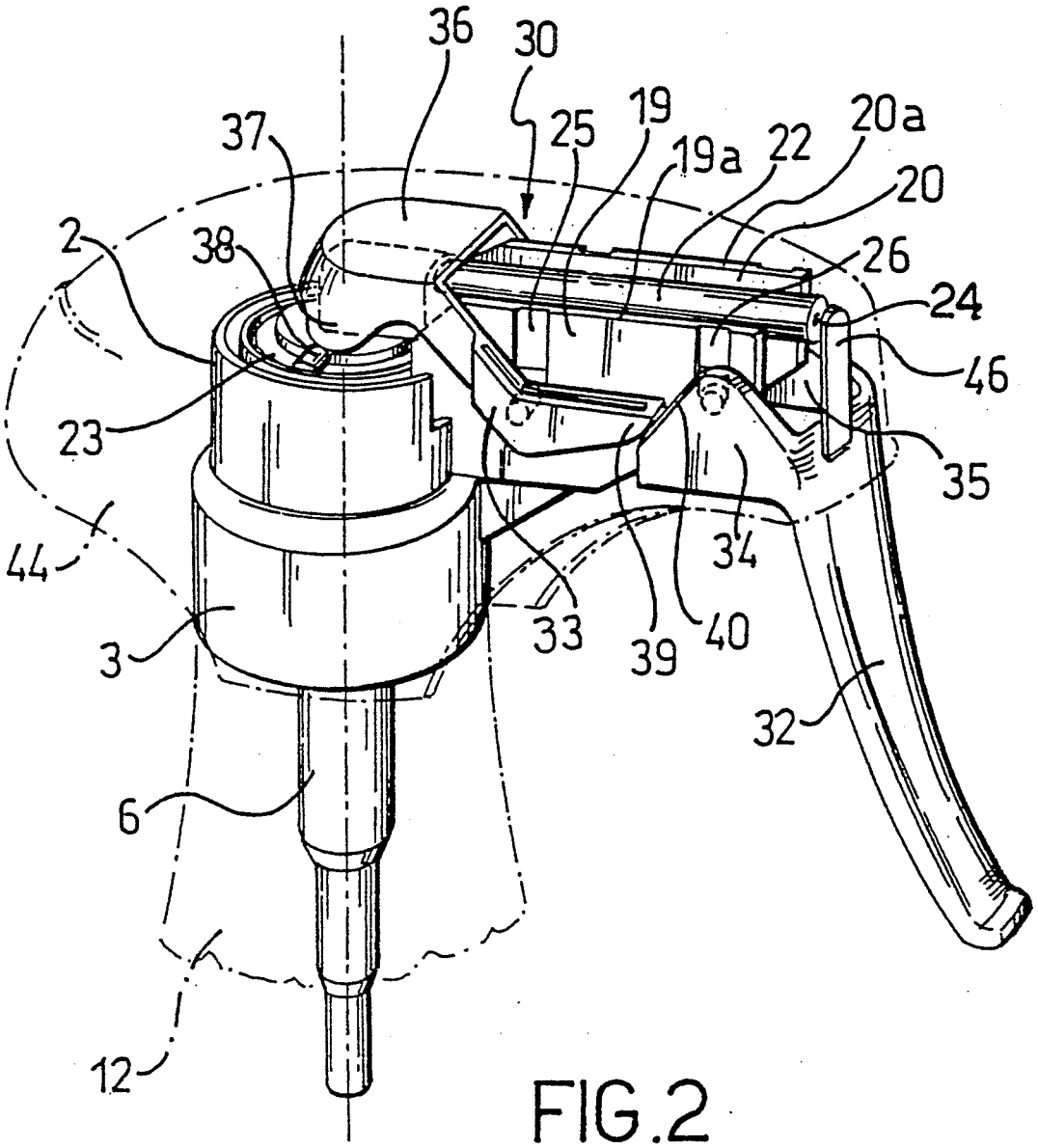
FIG. 2 shows in prespective the device of FIG. 1, in the assembled state thereof.
Figure 4:
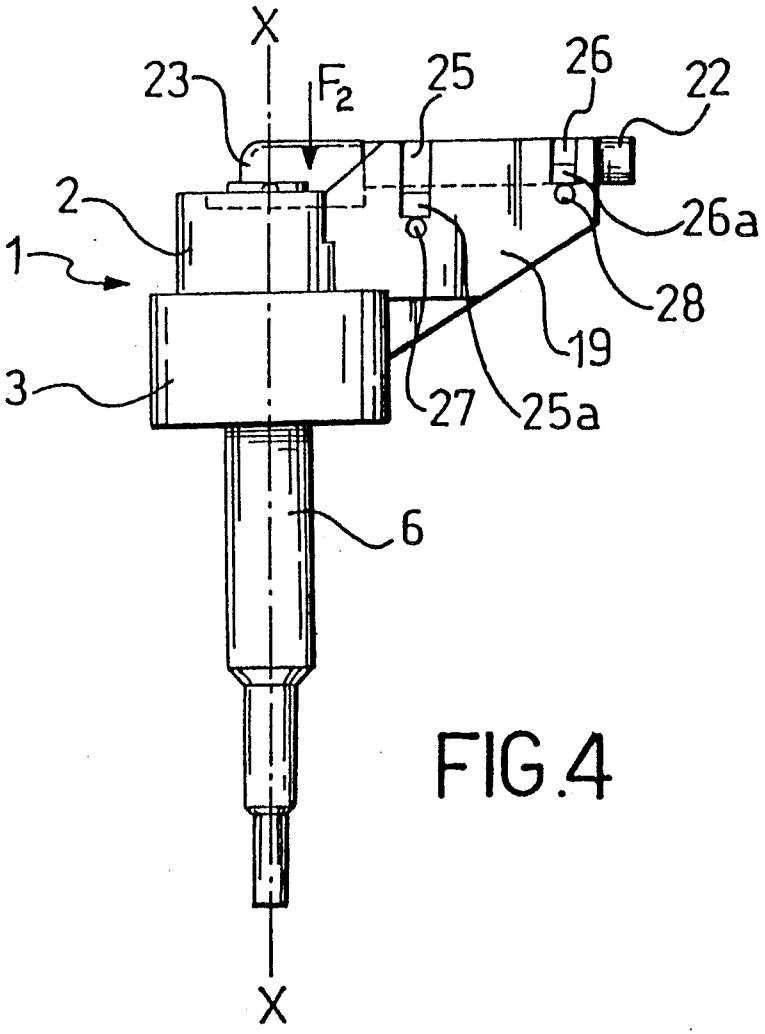
FIGS. 3,4,5 and 6 illustrate respective assembly steps for the components of the inventive device.
Figure 7:
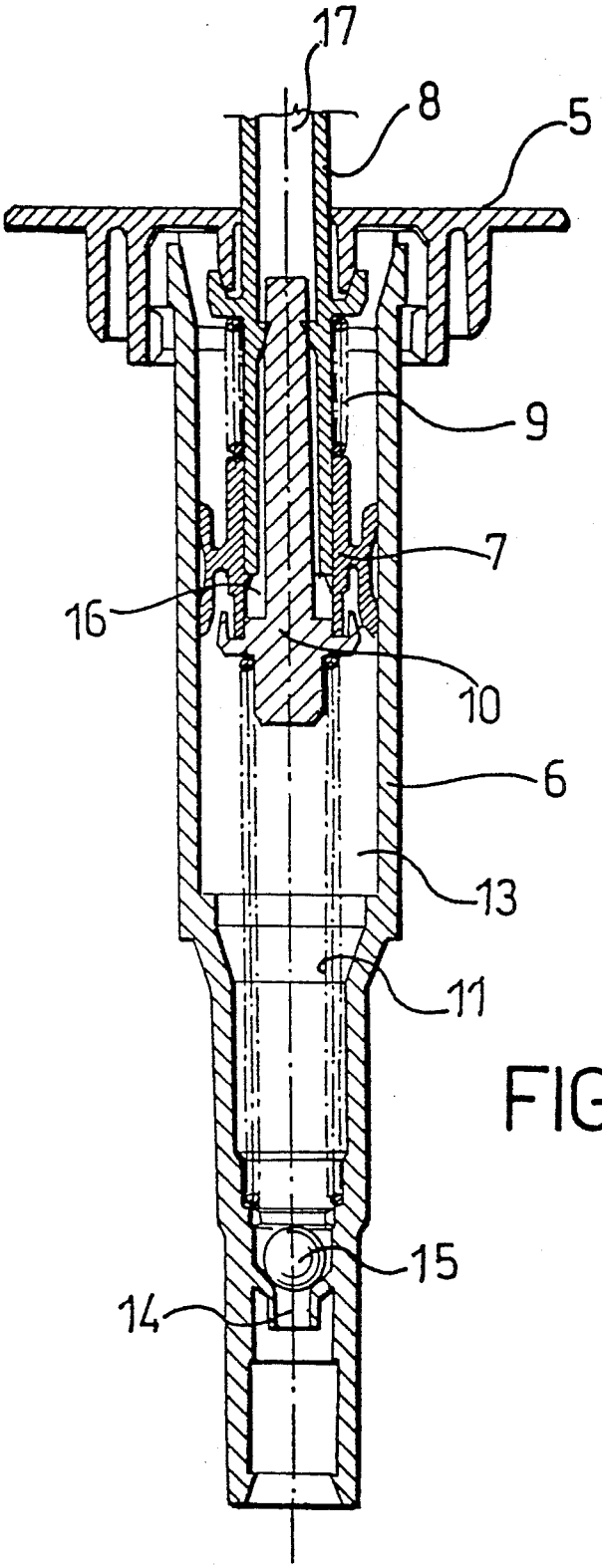
FIG. 7 shows a cross-section through an axial piston pump for operation by means of the inventive device.

With reference to the drawing figures, and specifically to FIGS. 1 and 7, generally shown at 1 is a base body comprising a tubular portion 2, an axial extension 3 whereof, of increased diameter, forms an annular inner ledge 4. This ledge is adapted to receive in mating relationship a cap 5 which is unitary with the cylindrical body 6 of an axial pump, known per se, whose interior accommodates an axially movable piston 7 which is driven by a tubular rod 8 through an intervening spring 9, cylindrical body 10, and additional coil spring 11.

In a conventional way, a liquid to be sprayed is drawn up from the container 12 into the chamber 13 of the cylinder 6 through a port 14, under control by a ball valve 15.

Delivery of the liquid, in the form of an atomized spray, occurs by compression within the chamber 13 from the piston 7, which is displaced axially by the tubular rod 8, on the magnitude of this compression exceeding the set value of the spring 9, to produce a relative displacement of the piston 7 and the tubular rod 8. Pressurized liquid is driven into a space 16 and thence into the axial cavity 17 of the tubular rod 8 and toward the delivery conduit, as explained hereinafter.

Also with reference to FIG. 1, it should be noted that the inner wall 18 of the tubular extension 3 is provided with a threadway for its threaded connection to the neck portion of the container 12.

The tubular portion 2 has instead a pair of walls 19 and 20 which extend sideways parallel to each other and define a space 21 therebetween.

Accommodated between said walls is the delivery conduit 22 of the device delivery head 23, which head locates in the tubular portion 2 of the base body 1. The head 23 is connected, both mechanically and hydraulically. to the tubular rod 8, together wherewith it is driven axially during operation of the pump.

The conduit 22, having its longitudinal axis set at an angle, in particular a right angle, to the longitudinal axis X—X of the body 1, is terminated with a spray nozzle 24.

The walls 19 and 20 are formed, on their outward surfaces from the interspace 21, with respective grooves 25 and 26 which open at the location of the edge 19*a* and 20*a* and are terminated with circular cross-section recesses 27 and 28, with whose inlets they merge through respective ramps 25*a*, 26*a*.

While the depth of such grooves is preferably smaller than the depth of their respective recesses, their width is substantially equal to the diameter of said recesses.

In a preferred embodiment, said recesses are in the form of holes through the thickness of the walls 19, 20.

The juxtaposed pairs of grooves 25, 26 and respective recesses 27, 28 are designed, as explained more clearly hereinafter, to permanently accommodate by snap fitting cylindrical trunnions 29 of a rocker-lever 30 and cylindrical trunnions 31 of the trigger-type lever 32 during the assembly stage.

The cylindrical trunnions 29 are formed on the parallel arms 33 of the lever 30 which are designed to embrace from outside with respect to the space 21, the walls 19, 20 and snap into the corresponding recesses 27 after running, during the assembly stage, across the grooves 25, thereby providing the pivot axis for the rocker lever.

The cylindrical trunnions 31 are instead formed on ears 34, 35 unitary with the trigger-type lever 32. These trunnions are designed to engage by snap action in their corresponding recesses 28, after running across the grooves 26 during the assembly stage, and provide the axis whereabout the angular movement of the trigger-type lever will occur when operated by the user.

The arms 33 are joined together at one end by a bridge 36 which is intended to merely bear, with its portion 37, on ribs 38 of the delivery head 23. The other end 39 of the arms 29 is for face engagement with camming surfaces 40 of the ears 34, 35 of the trigger-type lever 32.

The tubular portion 2 of the base body 1, moreover, is provided with an annular interspace 41 into which a collar 42 is adapted to fit, which is held securely by supporting ribs 43 in the inner cavity of a cap 44 whose outer shape is dictated by the shape of the container 12 wherewith the device is to be engaged for operation.

This cap is formed in its front region with a slit 45 which, on completion of the assembly process, will locate in front of the delivery orifice 24 to allow the spray to pass through.

At the location of said slit 45, a new device would carry a tamper-proof tab 46, unitary with the trigger-type lever 32, which is intended for automatic rupture on first use of the device.

As may be best appreciated from FIGS. 3, 4, 5 and 6, the device of this invention can be assembled by assembly steps which all proceed along parallel directions to the axis X—X of the base body, one way and the opposite way, without involving transverse assembly directions to said axis which would require more complex an expensive automated equipment.

Figure 3:
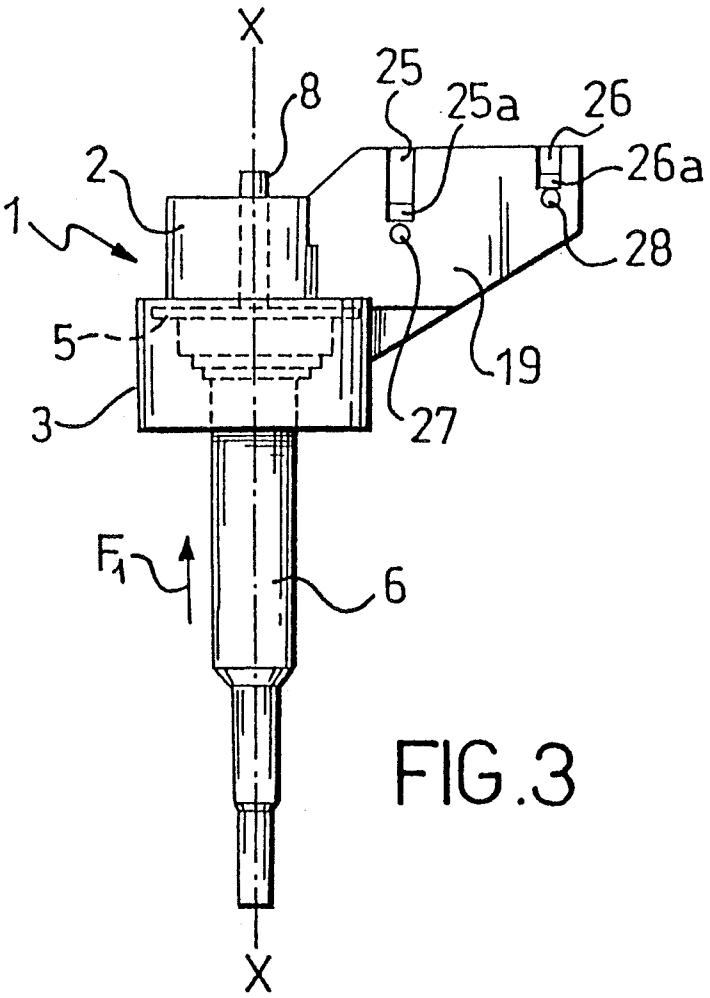
Figure 6:
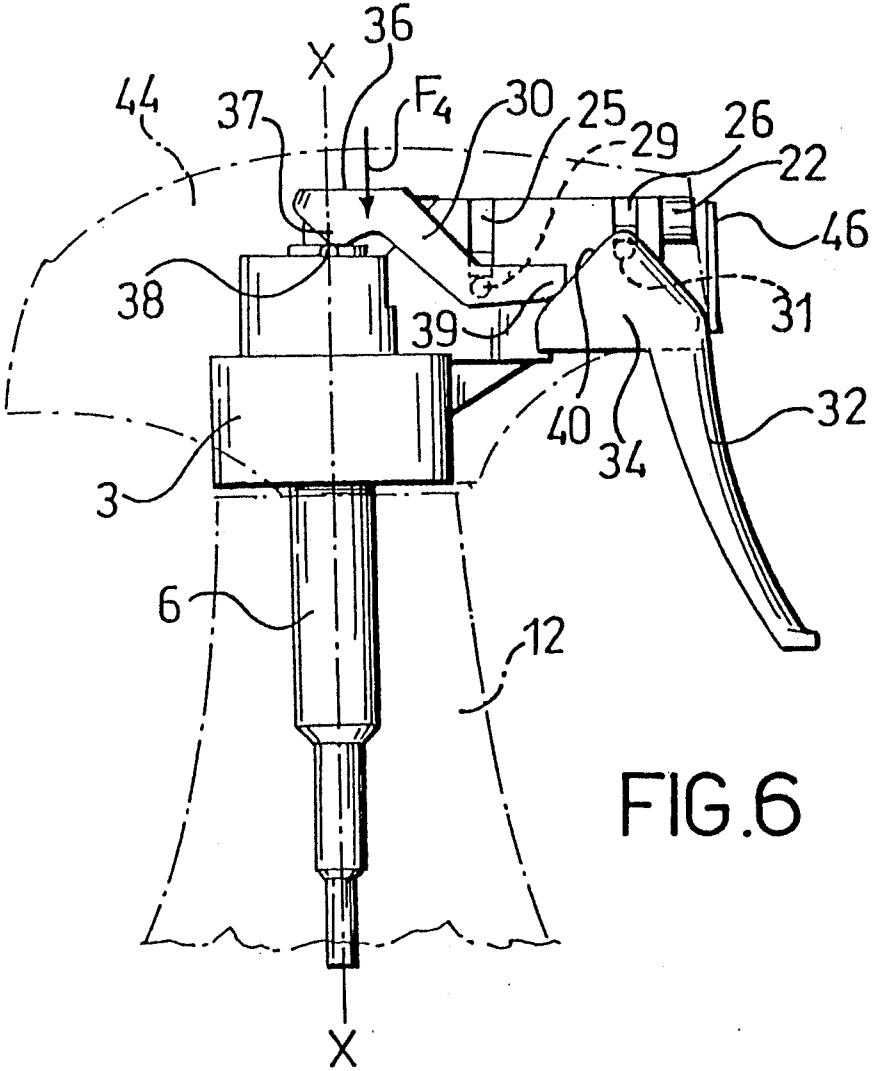
Figure 5:
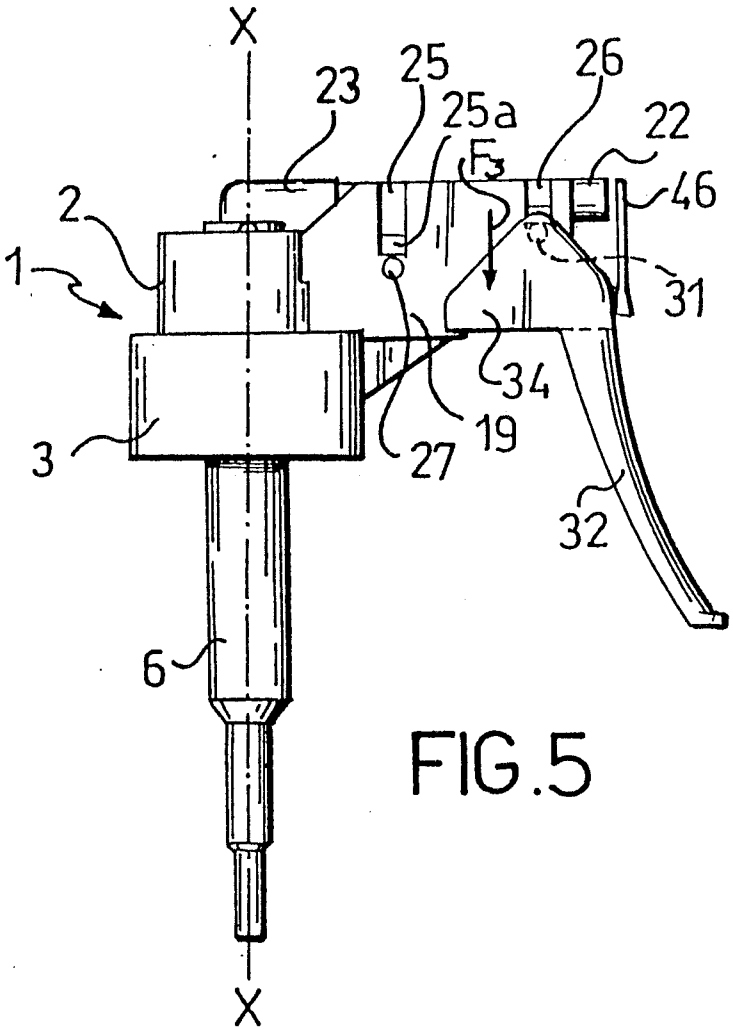

As may be seen in FIG. 3, in fact, the pump assembly is introduced into its tubular housing 3 with an upward axial movement in the direction of arrow F1. The assembly comprising the delivery head 23 and its delivery conduit 22 is introduced into its tubular housing 2 with a downward axial movement along the direction of arrow F2 until the head 23 becomes engaged with the tubular actuating rod 8 of the pump. Thereafter, as may be appreciated from FIG. 5, the trigger-type lever 32 is assembled with an axial movement performed along the direction of arrow F3, parallel to that of arrow F2 and the axis X—X, by sliding the trunnions 31 across the grooves 26 to cause them to snap into the recesses 28. In a similar way, with a movement performed along the direction of arrow F4, the rocker lever 30 is finally assembled by sliding engagement of the trunnions 29 in the grooves 25 and subsequent snapping thereof into the recesses 27.

The rocker lever will be thereby brought to rest, with its end 37, directly on the rib 38 of the head 23, and with its end 39, directly on the camming surface 40 of the ears 34, 35.

The angular displacement movement of the trigger-type lever 32 along the direction of the axis X—X causes the end 39 of the rocker lever 30 to be lifted. The downward movement of the end 37 of the latter imparts a corresponding axial movement to the head 23, and hence to the tubular rod 8 driving the pump piston.

Thus, the motion is transferred through structural elements that are compact and limited in their longitudinal dimension, which greatly improves their flexural strength.

As may be appreciated, the spray pump operating device of this invention enables an assembly procedure which involves no screwing or transverse insertion of pins to create pivot or swing axes.

It also provides a unit which can, through the base body 1, be handled independently and associated with the container 12, irrespective of the design or configuration of the latter, by attachment of the cap 44.

The inventive device affords, therefore, important economical advantages inherent to the possibility of mass manufacture thereof, by virtue of its construction being unrelated to the type of container on which it is to be installed.

Understandably, the dimensions and materials may be any ones contingent on individual demands, without departing from the scope of the invention as described in the foregoing and claimed hereinafter.

I claim:

1. A device for spraying liquid from a handheld container, comprising:

a base body having a tubular portion and a pair of unitarily formed side walls which are parallel to and spaced from each other to define an interspace therebetween;

a pump having a piston mounted for axially movement, a bias spring engaged with the piston for resisting movement of the piston, a delivery head mounted for axial movement with the piston and against a force of the bias spring for spraying liquid, and a delivery conduit extending at an angle to a direction of axial movement of the piston, the delivery head being positioned in the tubular portion of the base body and the delivery conduit extending between the side walls and in the interspace, the delivery conduit being integral with the delivery head;

a trigger lever having a pair of parallel ears which are spaced from each other and embrace outer surfaces of said pair of side walls, outside of said interspace between said side walls, said ears being provided with respective means for swinging engagement, mated with counter-means formed on the outer surfaces of said side walls, for angular movement of the trigger lever in substantially the same plane as a plane containing the delivery conduit; and a rocker lever operatively engaged with the delivery head and operatively engaged with the trigger lever for converting angular movement of the trigger lever into axial movement of the delivery head, said rocker lever being pivotally mounted to said base body and including a pair of parallel spaced apart arms embracing the outer surfaces of the side walls, outside said interspace, a small bridge interconnecting said arms, said rocker lever having ends operatively engaged with said delivery head, each arm being provided with respective means for swinging engagement with mating counter means provided on the outer services of said side walls, for pivotally connecting said rocker lever to said base body.

2. A device according to claim 1, in which said rocker lever is engaged with said trigger lever by a face cam coupling.

3. A device according to claim 1, in which said rocker lever is engaged with the delivery head of the pump by a rest-type coupling.

4. A device according to claim 1, including a cap covering at least part of said base body and a collar in said cap over said pump, said tubular portion of the base body comprising an annular interspace for detachable receiving in interfit relationship, the collar.

5. A device according to claim 1, in which said means carried on each arm of said rocker lever comprise a trunnion having a circular cross-sectional shape and said mating counter-means carried on the confronting surfaces of the juxtaposed walls comprises a circular cross section recess located at the end of a straight groove open at opposed end which is formed in the wall surfaces and extends parallel to the axis of the tubular portion of said base body.

6. A device according to claim 1, in which said trigger lever is mounted on said base body at free ends of said side walls.

7. A device according to claim 1, in which said means of swing engagement carried on each ear of the trigger lever comprise a trunnion having a circular cross sectional shape and in which said mating counter-means comprise a cylindrical cross section recess located at an end of a straight groove open at its opposed end and being formed on the juxtaposed wall surface parallel to the axis of the tubular portion of said base body.

8. A device according to claim 7, in which said grooves have a smaller depth that the depth of their respective recesses formed on one end thereof and width at least equal to the diameter of said respective recesses.

* * * * *